US006926158B1

(12) United States Patent
Brown

(10) Patent No.: US 6,926,158 B1
(45) Date of Patent: Aug. 9, 2005

(54) SUSPENSION SYSTEM FOR FILE FOLDERS

(75) Inventor: Arthur E. Brown, Mission Viejo, CA (US)

(73) Assignee: Arthur Brown, Inc., Mission Viejo, CA (US)

( * ) Notice: Subject to any disclaimer, the term of this patent is extended or adjusted under 35 U.S.C. 154(b) by 356 days.

(21) Appl. No.: 09/779,901

(22) Filed: Feb. 8, 2001

Related U.S. Application Data

(60) Provisional application No. 60/181,064, filed on Feb. 8, 2000.

(51) Int. Cl.[7] ..... A47F 5/00

(52) U.S. Cl. ..... 211/46; 211/189; 312/184; 312/330.1

(58) Field of Search ..... 312/183, 184, 312/330.1; 211/45, 46, 189

(56) References Cited

U.S. PATENT DOCUMENTS

| | | | | |
|---|---|---|---|---|
| 1,524,348 | A * | 1/1925 | Field | |
| 2,678,651 | A * | 5/1954 | De Whalley | |
| 2,910,985 | A * | 11/1959 | Epstein et al. | 40/651 |
| 3,238,947 | A * | 3/1966 | Churnick | 211/162 |
| 3,539,235 | A * | 11/1970 | Cuenca | 312/184 |
| 4,053,057 | A * | 10/1977 | Snowden | 211/126.13 |
| 4,219,247 | A * | 8/1980 | Litchfield et al. | 312/184 |
| 4,232,596 | A * | 11/1980 | Kroll et al. | 312/184 X |
| 4,576,328 | A * | 3/1986 | Snider et al. | 229/67.1 |
| 4,893,745 | A * | 1/1990 | Weber et al. | 229/67.2 |
| 5,311,685 | A * | 5/1994 | Wyant et al. | 40/359 |
| 5,996,881 | A * | 12/1999 | Smith | 229/67.1 |
| 6,332,285 | B1 * | 12/2001 | Aaldenberg et al. | 40/641 |

* cited by examiner

*Primary Examiner*—Robert W. Gibson, Jr.
(74) *Attorney, Agent, or Firm*—Stout, Uxa, Buyan & Mullins, LLP; Donald E. Stout

(57) ABSTRACT

A hanging file system composed of one or more file support members effectively attached to one cross-support member and spanning a pocket area before being effectively attached to a subsequent cross-support member thereby creating a pocket area of which the sides are not solid areas.

5 Claims, 21 Drawing Sheets

Removably attached as manufactured
134
135
ATTACHED
102
131
132
METHOD of Tucking tip out of folder area without long tab 134
alternative fig 10

SUSPENSION SYSTEM FOR FILE FOLDERS

FIELD OF THE INVENTION

This invention relates to the field of hanging pockets for file folders, and more specifically the pockets or divisions in which the file folders are traditionally placed.

RELATED CASES

This application claims the benefit of provisional application Ser. No. 60/181,064 filed 8 Feb. 2000.

BACKGROUND OF THE INVENTION

In many filing systems, the individual file folders are placed inside dividers or pockets that are suspended or hung on both sides of the files from lengthwise supports running perpendicular to the files and the length or width of the drawer. Generally each pocket for a file folder is formed by using an individual unit comprised of two supporting bars which hang and slide on the lengthwise supports and from which a material, generally a heavy paper stock is suspended creating a sling or pouch which supports an inserted file folder. Into these hanging pockets, the individual manila-style file folders are placed. In addition it is advantageous to label the file pockets to indicate the contents of each.

This method of maintaining files in a drawer, however, is grossly inefficient. This is because the hanging file pocket itself requires a considerable amount of the available filing space. In a case where individual sheets of paper are stored in their own folders each in its own hanging pocket, it is typical that 50 times as much space is wasted housing the folders and folder holders as is actually taken up by the documents being filed. Therefore a filing drawer 20" deep would be able to hold less than 100 pieces of paper, which of themselves combined and in their entirety require less than ½" of drawer space. This is terribly inefficient causing valuable office space everywhere to be consumed by multiple filing cabinets, which are mostly holding the hanging file holders themselves.

In addition, this method of hanging folders creates a gap between each individual file folder. When returning a folder to the drawer, a user is almost as likely to drop the folder of documents between two adjacent pockets as they are to place them in a pocket. If the folder is not retrieved immediately and placed correctly, it can slide to the bottom of the drawer below the hanging pockets and be lost.

Much of the value of the hanging folder approach is to create a useable order to the filing system. A correct sequence for the contents of a filing drawer or a filing cabinet, (or filing space), is created and the pockets are labeles accordingly. From this it follows that it is important to keep each pocket in its correct location within the drawer, (or filing space), so the pocket itself does not become misfiled, either out of sequence or in the wrong drawer, (or filing space). In the current systems it is as easy to remove the pockets themselves from the drawer as it is the contents. Thus the specific and correct location for the file within the filing space is lost and the proper returning of the file is left to chance. This leads to files being lost within the file space because the system does not prevent their being placed in a wrong or even arbitrary location.

At every point, from manufacturing through shipping, distribution, storage and final use, the physical size of the current hanging pockets is a costly issue. Every pocket, whether letter or legal, is inherently deeper and longer than the objects it is designed to hold. This creates a size and weight factor to be considered in every aspect of manufacturing, packaging, shipping, storing, and distributing the product. This inherent bulk of the current products could easily be a deciding factor in determining whether or not a manufacturing facility located at a distance from the end users would be economically feasible. Even though advantages in labor or technology may be present, the costs associated with shipping from a given location may outweigh the advantages.

The current design, requiring a full enclosure from front to back, top to bottom of each pocket, requires a substantial amount of materials. This limits the selection to a cost-effective material rather than an optimum material for manufacture, performance, utility, appearance, or other points of view.

Environmentally, it is unjustifiable and unnecessary to create a double wall of paper-board and manila to hold files within an enclosed drawer of filing space.

Thus, there is a need for a system which maintains the key advantages of a hanging filing system while maximizing storage efficiency, minimizing lost and mis-filed files and introducing advantages to manufacturing and distributing and using fewer natural resources.

SUMMARY OF INVENTION

The present invention provides a hanging file folder pocket system and method for creating individual locations for filing folders and other objects. In one aspect of the present invention, a representative system of a certain number of pockets is provided. In one embodiment, the pockets are formed by connecting, registering or being supported by an essentially continuous and effectively fan-folded member to a series of cross supports to create multiple filing areas to hold and support the file folders or other objects. These filing areas are supported and defined by the cross supports with only a single cross support between each consecutive pocket. In another embodiment, the essentially continuous and effectively fan-folded member is a net or webbing or other member where the strength and rigidity of the member is enhanced by the interconnection of portions of the member while substantial amounts of voids are created within the member. In another embodiment, the filing areas are similarly created by multiple members whose combined widths are less than or equal to the width of the filing pocket. Each member is essentially continuous and is connected in order of sequence to the series of cross-supports. Thus each file folder or other object is supported by a multiple of members spaced along the lower spine of the folder or lower edge of the object. In another embodiment either the single or multiple members are attached to both a front and back cross support creating a single pocket. Subsequent and additional pockets are created by effectively duplicating this construction as described while using in common a single cross support to create the front portion of one pocket and the back portion of the adjacent pocket.

In another aspect, the present invention provides a file-supporting member which can be disconnected from one cross-support and attached to a second cross-support. This member may be re-connected using the same method which connected it to the first cross-support, or it may be connected to the second cross-support using a different method.

In another aspect, the present invention provides a method of attaching a file-supporting member to a cross-support where the point of attachment on the cross-support transfers the weight held by the file-supporting member to a point below the points at which the cross-support is supported by the lengthwise supports.

Another aspect of the present invention provides a method of creating a tab of the same material of which the file-supporting member is created. Said tab extends generally vertically above the cross-support to indicate, or have attached to it a label or method to indicate, the contents of the adjacent pocket. A choice from multiple distinct positions on the file-supporting member across the top of the cross-support can be made.

Another aspect of the present invention provides a method of attaching to the cross-support a tab to indicate, or have attached to it a label or method to indicate, the contents of the adjacent pocket. This attachment is made in a manner that allows the tab to be positioned in various locations across the top of the cross-support. These positions may be indicated either visually with marks discernable to the eye or physically indicated by means such as indentations which register to a matching feature on the tab.

Another aspect of the present invention provides a method of providing a pre-assembled and pre-labeled hanging file pocket system with the appropriate manila-style file folders. Both the file pockets and the file folders may be pre-labeled or pre-marked such as with color indicia to create a relationship between certain folder(s) and a specific pocket.

Advantageously, the present invention provides a hanging file folder pocket method and system with improved filing density, accuracy, manufacturability, distribution, and marketability.

SUMMARY OF USE

An every day example of use is to hold manila-type folders containing papers etc within a drawer. Such a function is currently commonly achieved by using the individual hanging file folders which have a method by which they are individually suspended between two supports which generally run the length of a filing drawer. Such a system includes a drawer, a set of lengthwise supports and the individual hanging file folders. Anyone in a office environment would be familiar with or quickly learn the use of these. The invention is used in a similar setting such as a drawer, and with similar lengthwise supports. In some embodiments, individual hanging file folders similar in use are claimed. A user would be able to file in these in a manner virtually identical to what is currently performed. Such an embodiment would support the contents of the pocket on one or more file-supporting members. The number, size and spacing and general configuration of the file-supporting members would be chosen to match the intended use and contents of the hanging file folder.

In its more complete use, a system of hanging file folders is claimed. This system would be added to a filing area as a unit. In some embodiments the pockets are pre-labeled and save time and expense in doing this manually. In the use of a system, a select number of pockets or hanging file folders would be added or removed from a filing area at a time. Contents would be added, removed or moved from pocket to pocket as is currently done. In such a system, the hanging folder would not be removed from the filing area. It would remain in place, and the contents would be removed as needed. Thus the proper location to which the contents are to be returned would be kept. File folders would no longer be as easily mis-filed with in a filing area. Once in place within a drawer, the use of such a system would be virtually identical to the current methods, with the advantages detailed elsewhere in this patent. Another feature claimed is the pocket divider which is used to create multiple discrete filing locations within a single pocket. The use of these simply requires labeling the tab as desired and inserting into a pocket where desired. By design, it created a vertical separator which looks and functions like the sides of the pocket to separate contents and provide a visual indication of separation and identification of contents. Another feature claimed is a method for adding or removing pockets from a hanging file folder system. This is accomplished by removing the contents of the affected pockets, detaching the file support members from the appropriate cross-members, inserting or removing the necessary cross-supports and file-support members and appropriate according to the model and style of system used. In general a method of removing and reattaching individual file-support members to cross-supports is provided in such systems. Another feature claimed allows the depth or capacity of individual pockets to be adjusted. As above, it requires a simple process of removing, adjusting and re-attaching a file-support member to the appropriate cross member Another feature claimed is a tab used for identifying the contents of an adjacent pocket. Such a tab is created by causing a portion of the file supporting member to protrude above the cross support member. Currently identification is accomplished by adding a separate member generally in a manner that is prone to being inadvertently knocked off. By creating a tab as part of the folder, time and materials are saved and the identification is more secure. Such a tab can be labeled by adding an adhesive label or using a clear or transparent plastic housing to cover and hold a paper or other method of labeling the contents. Another feature claimed is a tab used for identifying the contents of an adjacent pocket. Such a tab is attached to the portion of the cross support which is not fully covered by the file-support member. The use of such a tab is similar to the above. The advantages include a more substantial and easier method of attachement, the ability to move the tab to various positions along the cross-support and the ability to have the tabs attached during the manufacturing process. Thus the use of any individual pocket, multiple pocket system, adjustable capacity, or tab is readily accomplished.

DESCRIPTION

In the following detailed description, reference is made to the accompanying drawings that form a part hereof, and in which are shown by way of illustration specific embodiments in which the invention may be practiced. It is understood that other embodiments may be utilized and structural changes may be made without departing from the scope of the present invention.

The description herein will discuss a novel hanging file folder system and its use in storing file folders of typically letter and legal sized documents. However, it is to be understood that the discussion is merely exemplary and is not meant to limit the invention to traditional filing cabinets and drawers, or lateral files, and that many other uses and applications are within the scope of the present invention.

Figure 1:
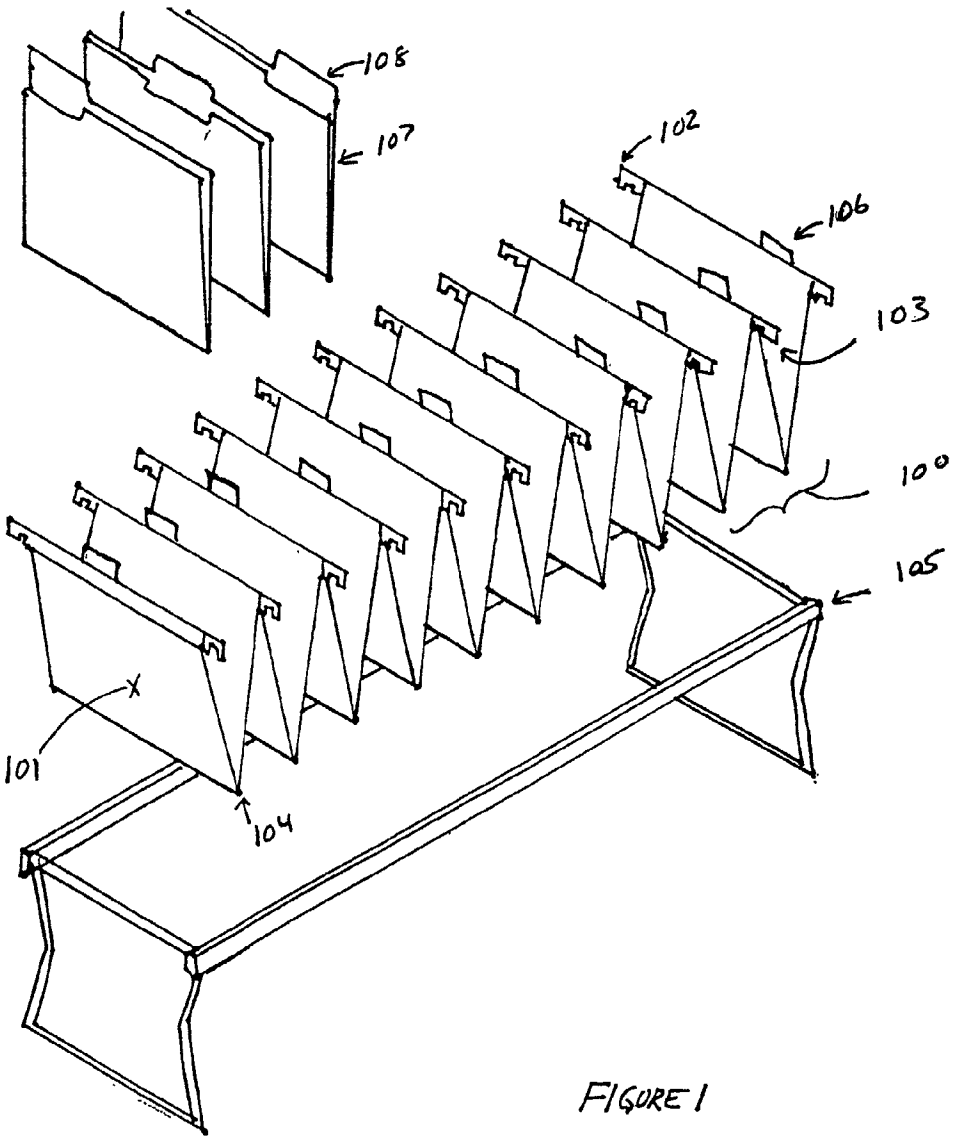
FIG. 1 shows one embodiment of a hanging file folder pocket system with multiple pockets each sharing a common cross-support between adjacent pockets according to the present invention.

FIG. 1 shows one embodiment of a hanging file folder pocket system according to the present invention. Hanging File Folder Pocket System 100 includes an effectively continuous file-support member 101 attached to the cross-support members 102. The individual pockets 103 are created by the file support member 01. This configuration creates a support for the folders 106 at the bottom fold 104. The cross-supports 102 rest upon and slide on the lengthwise supports 105 which are a part of and consistent with current hanging file folder supports. Traditional manila-style file folders 106 are placed in pockets 103. Tabs 106 on the pocket system identify which folder 107 is kept in which pocket 103. Tab 108 identifies the contents of folder 107. It is noted that a defined number of cross-supports 102, pockets 103, and file folders 107 are being used for descriptive purposes and are not to be construed as limiting the present invention. File support-member 101 is attached to each cross-support by any common means acceptable to the industry.

Figure 2:
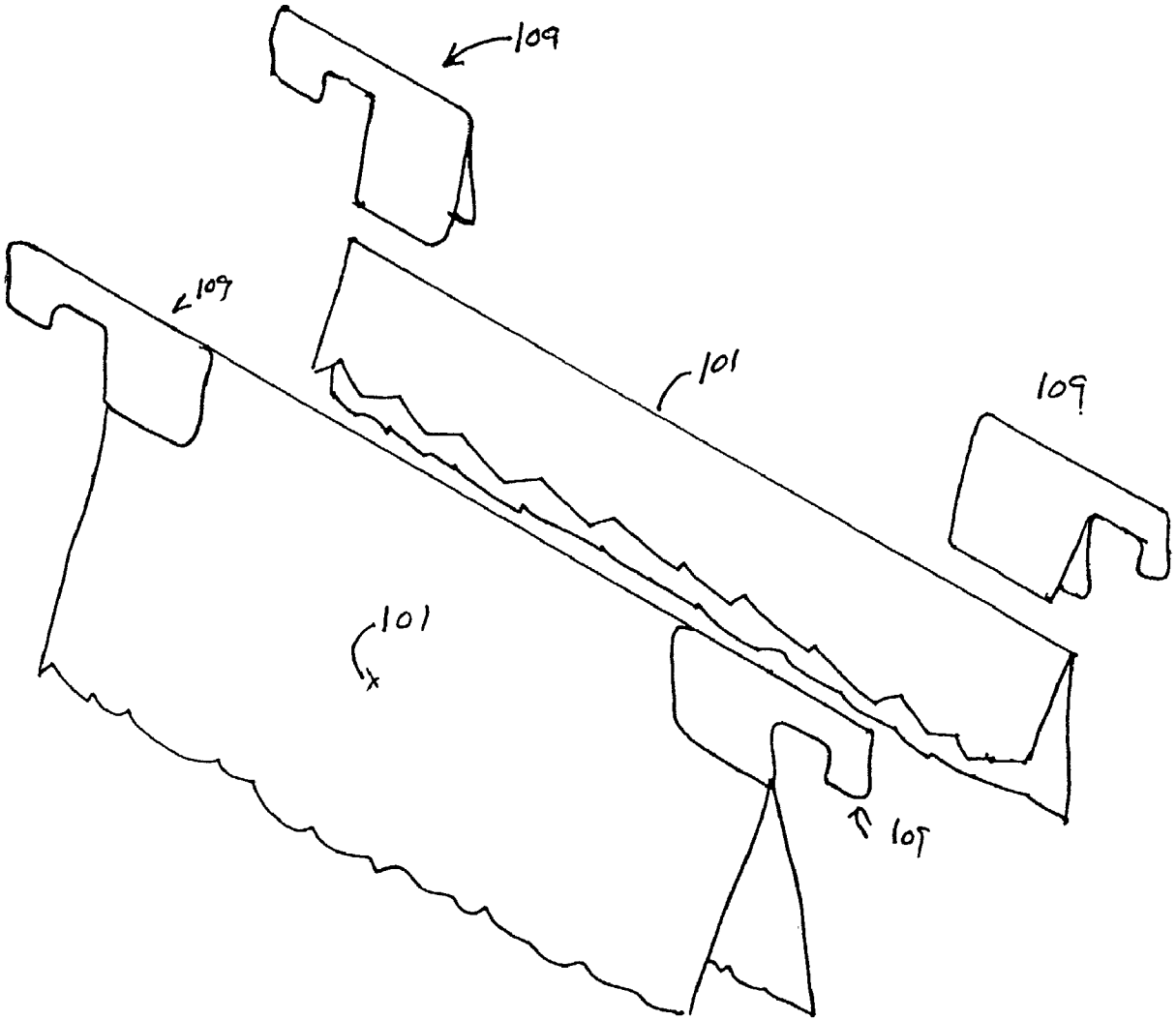
FIG. 2 shows one embodiment according to the present invention with a single file-supporting member.
Figure 3A:
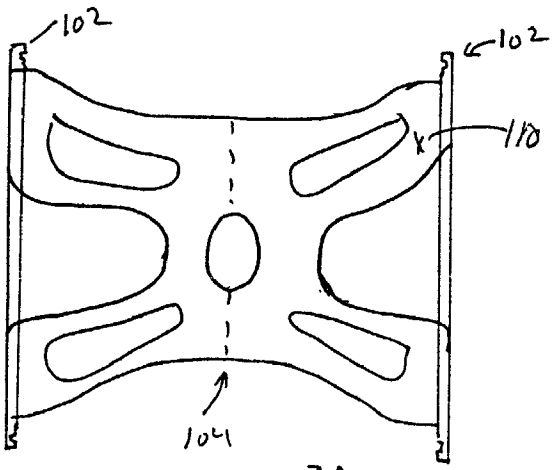
FIG. 3A shows one embodiment according to the present invention with a non-solid file supporting member.
Figure 3B:
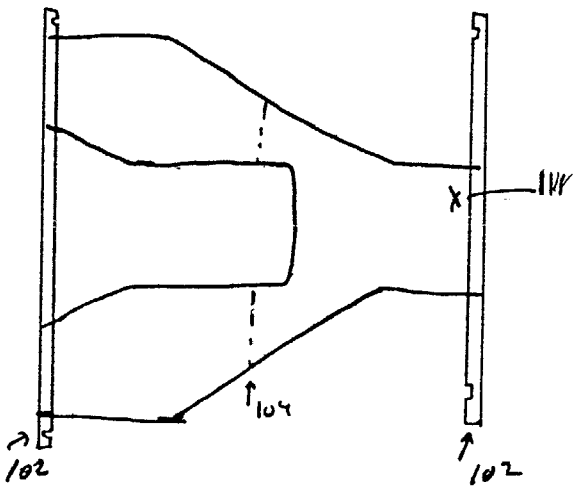
FIG. 3B shows a second embodiment according to the present invention with a non-solid file supporting member.
Figure 3C:
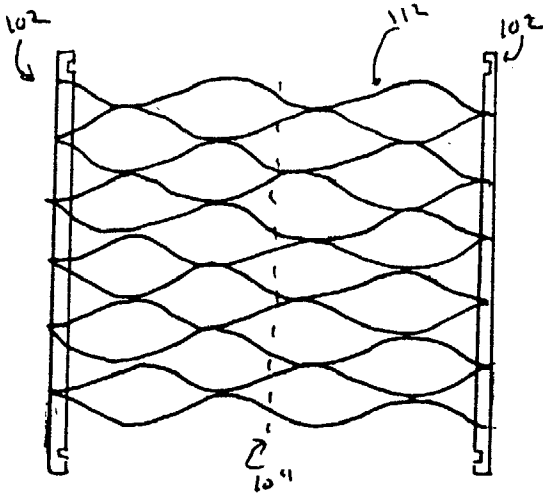
FIG. 3C shows a third embodiment according to the present invention with a non-solid file supporting member.
Figure 3D:
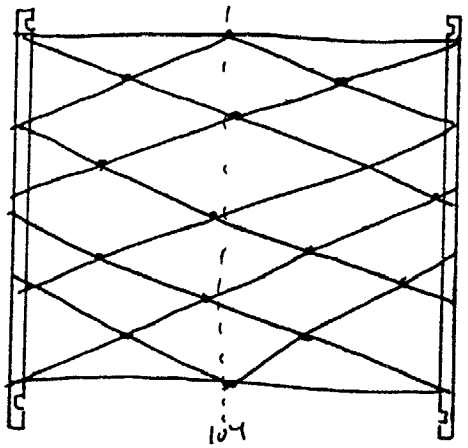
FIG. 3D shows a fourth embodiment according to the present invention with a non-solid file supporting member.

FIG. 2 shows a detail of one embodiment of the current invention in which a continuous file-supporting member 101 is attached to and supported by two individual end pieces 109. When thus attached the supporting member 101 and the two end pieces 109 create the effect of a single cross support with an attached file-supporting member.

FIG. 3 shows several embodiments of the current invention with non solid file-supporting members. FIG. 3 is shown showing an opened section of a single pocket area 103 from the front cross-support 102 to the rear cross support 102 of the same pocket area 103 with fold 104 being the bottom of the pocket. FIG. 3A shows 110 as representative of a solid sheet with sections removed for weight yet maintaining a full width of folder-supporting member 101 at fold 104. FIG. 3B shows 11 as representative of a solid sheet with sections removed for nesting during production and efficient use of materials. FIG. 3C shows 112 as representative of an expanded or a webbed element. FIG. 3D shows 113 as representative of a net element.

Figure 4:
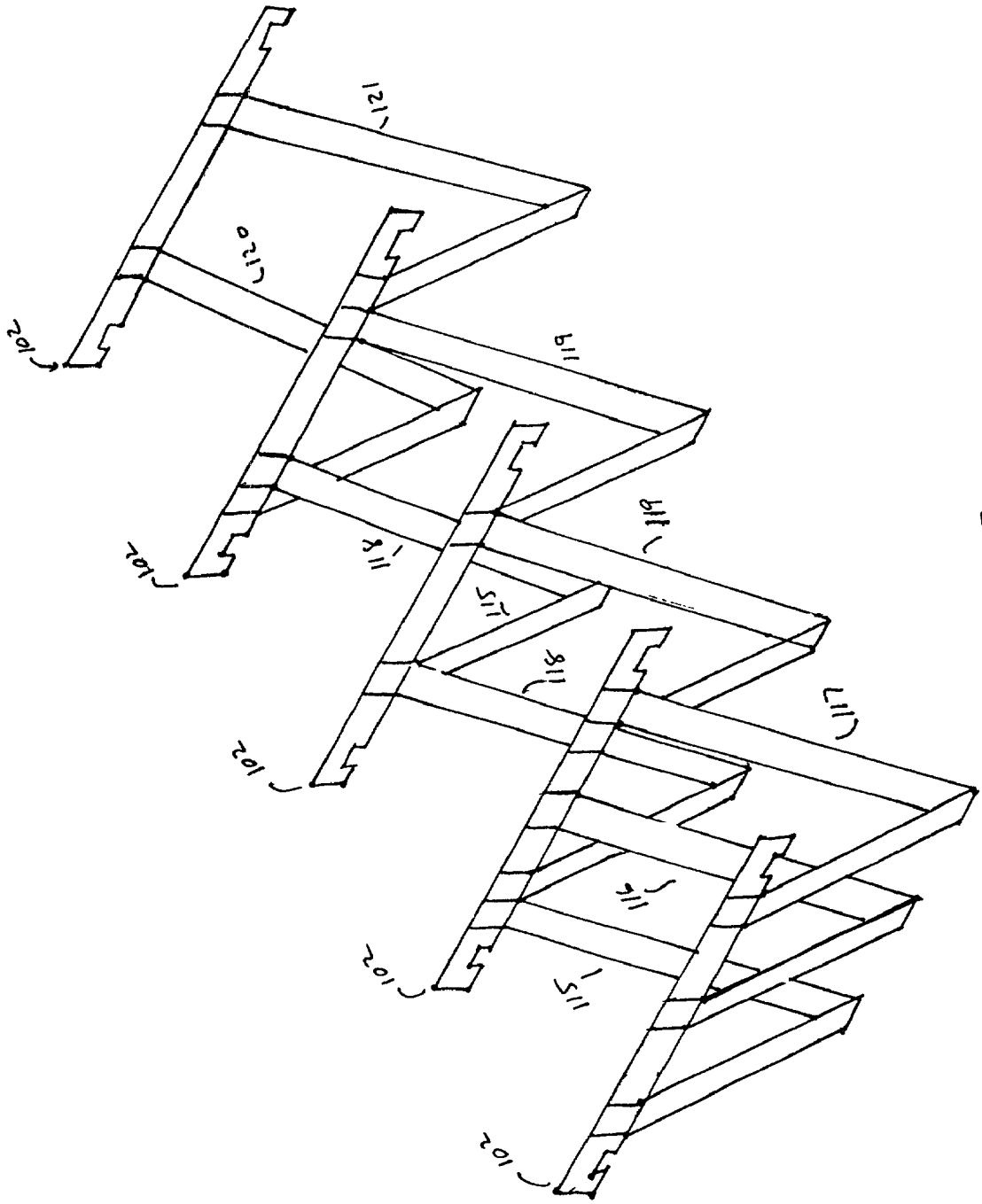
FIG. 4 shows one embodiment according to the present invention with multiple file-supporting members.

FIG. 4 shows an embodiment with multiple file-supporting members 114—that may be made of paper, ribbon, plastic or other materials. Members 115, 116, 117 represent more than two file-supporting members creating a pocket. Members 115, 116, 117 also represent an embodiment where the file-supporting members are not continuous from pocket to pocket. Members 118 and 119 represent an embodiment where multiple file-support members are continuously strung and attached to cross-supports 102 to form multiple consecutive pockets. Members 120 and 121 represent a method of staggering the connecting points on the consecutive cross-supports 102 demonstrating that it is not necessary for the file-supporting members to have a centerline perpendicular to the cross-supports.

Figures 5, 5A:
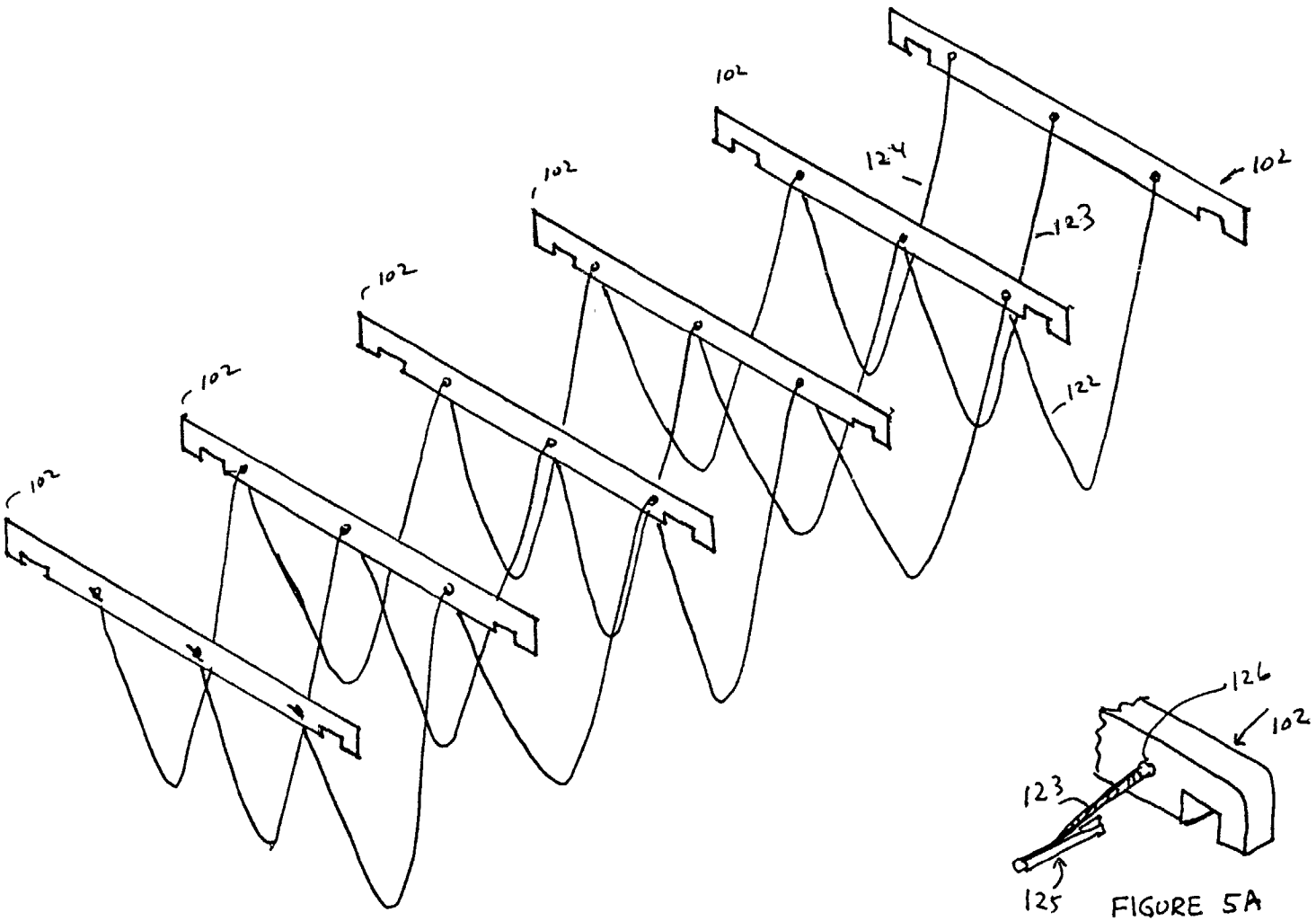
FIG. 5 shows one embodiment according to the present invention with the file-supporting member being formed of the same material as the cross-support.
FIG. 5A shows a detail view of a variant of the FIG. 5 embodiment.

FIG. 5 shows an embodiment with multiple file-supporting members 122, 123 and 124 that are made of a string-like material. In this embodiment it is also possible to stagger the holes so holes adjacent cross-supports do not share common centerlines. It is also possible in this embodiment to have file-support members that are not continuous from one file pocket to the next. FIG. 5A shows a detail of an embodiment of a method of attaching a string-like member to the cross-supports using a separate piece 125 which attaches securely to 123. End 125 is able to thread through hole 126 in 102 and will not pass back through 126 when turned sideways as is its natural condition.

Figure 6:
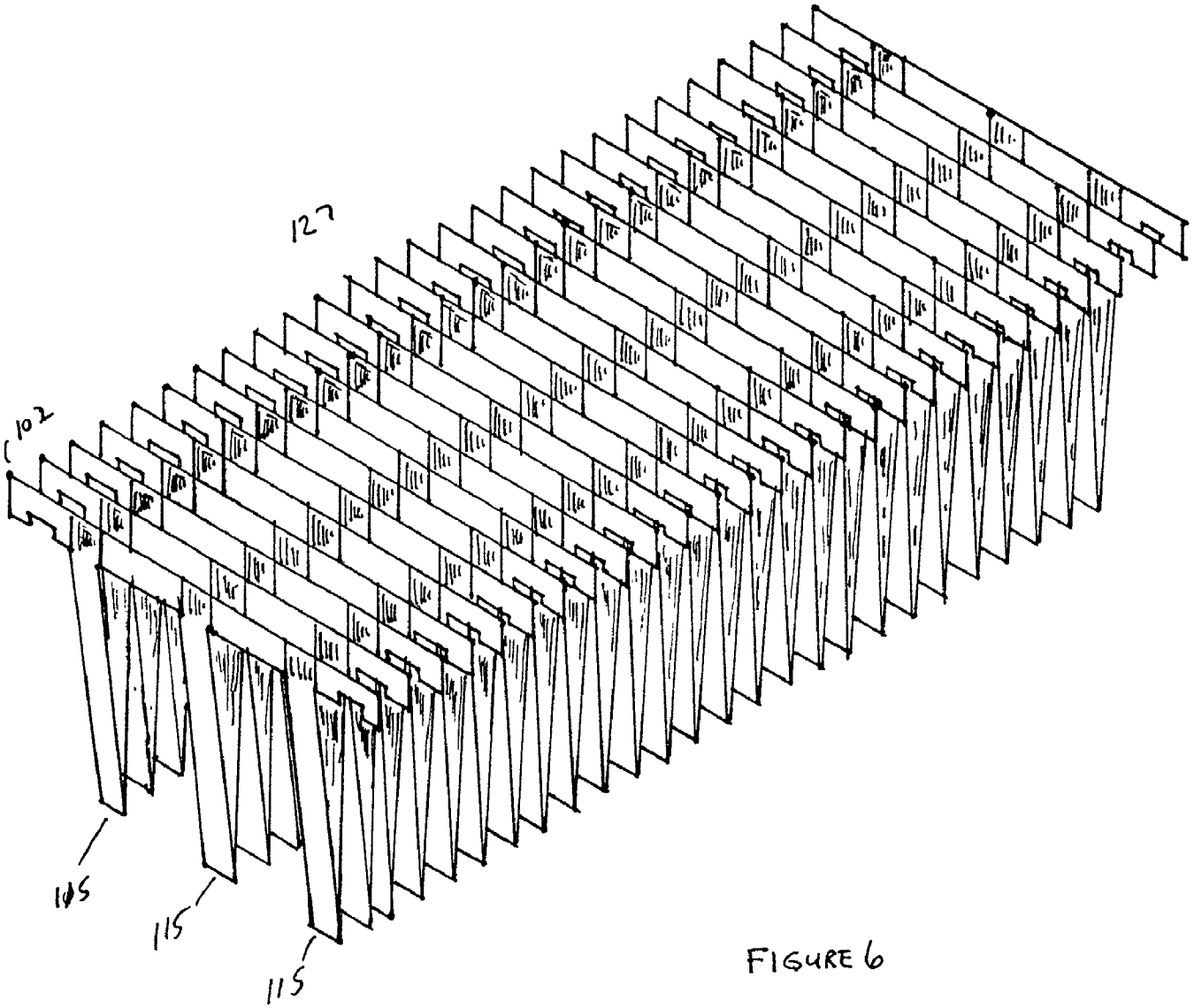
FIG. 6 shows one embodiment according to the present invention of a selected number of pockets presented as a single unit.

FIG. 6 shows an embodiment 127 showing a representative number of pockets presented for sale as a single unit. In this case, 127 is comprised of twenty-six (26) pockets 103 formed with twenty-seven (27) cross-supports 102 and three ribbon like file-supporting members 115.

Figure 7:
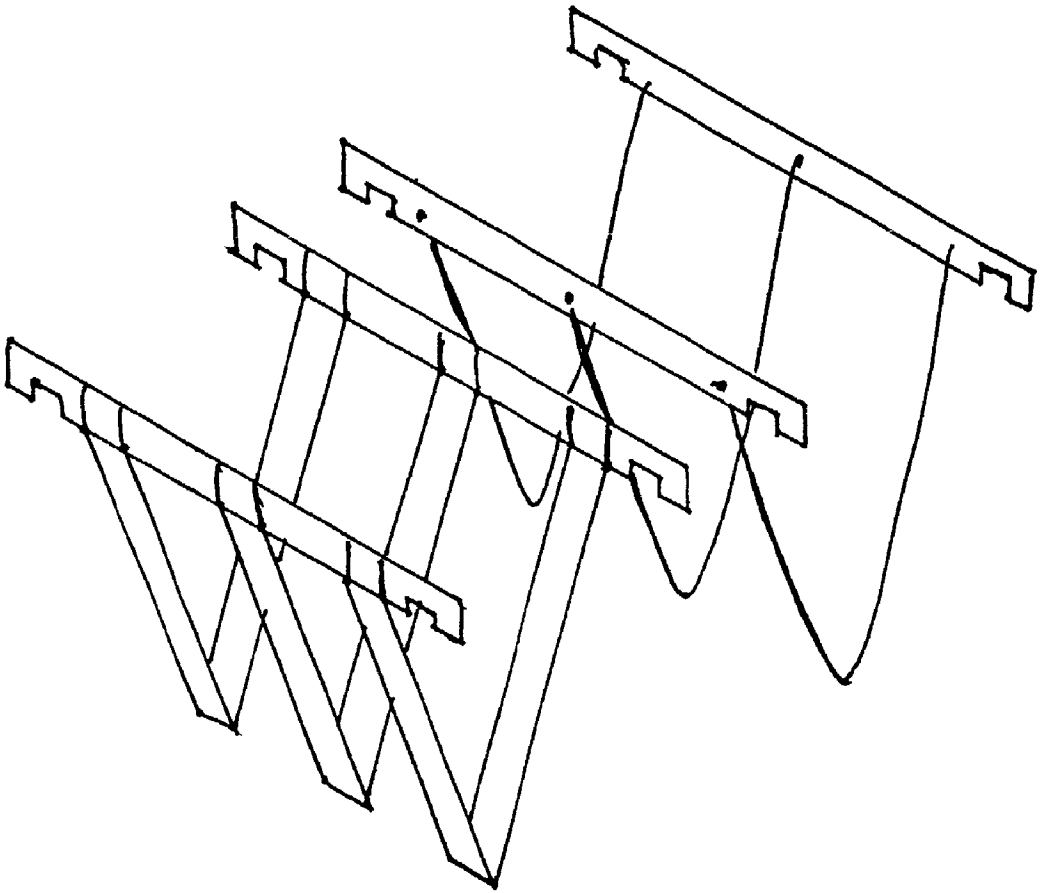
FIG. 7 shows one embodiment according to the present invention of individual pockets with two cross-supports formed with multiple file-supporting members.

FIG. 7 shows an embodiment 128 in which the file-supporting members may be any non solid configuration and using two (2) individual cross-supports.

Figure 8:
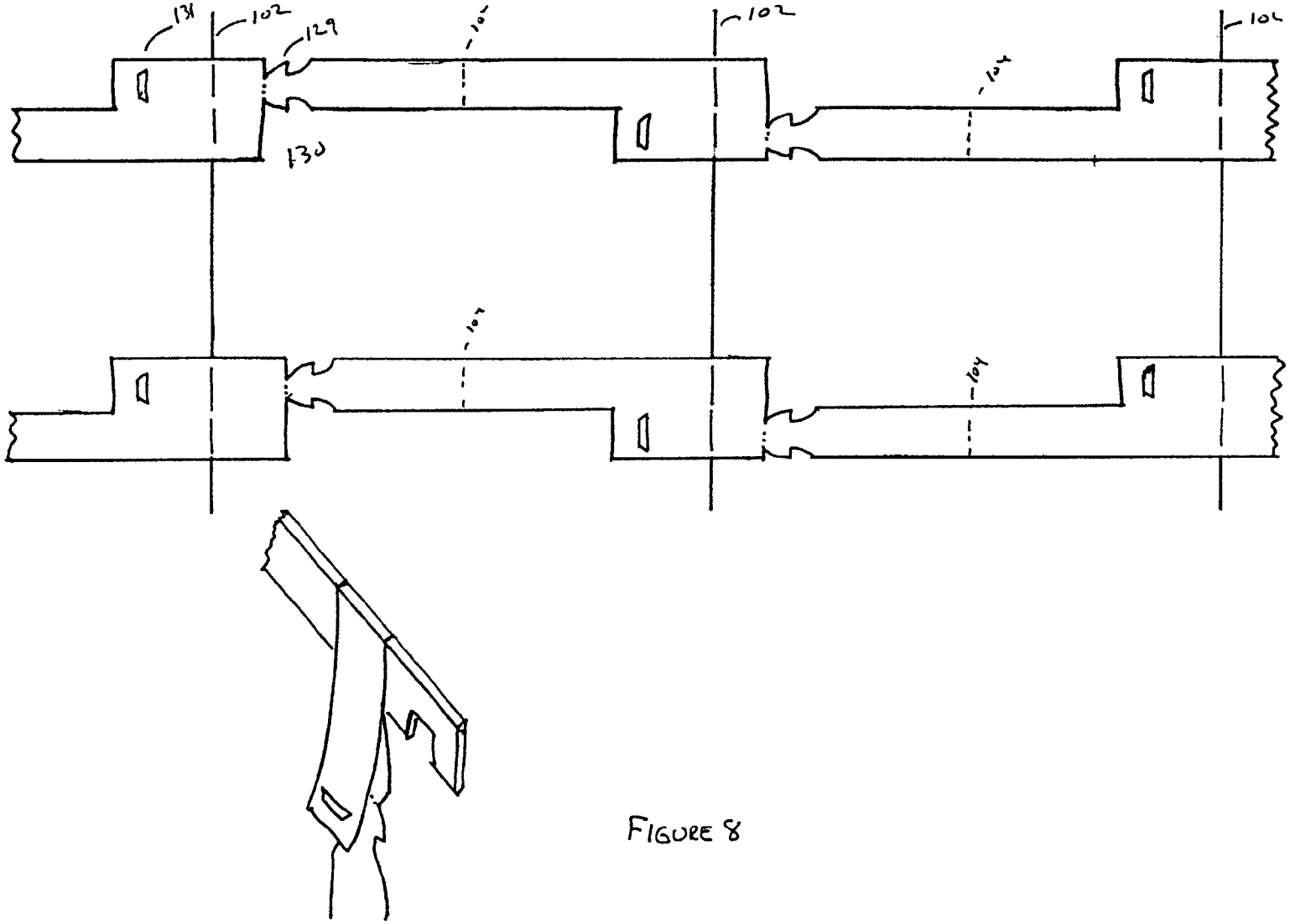
FIG. 8 shows one embodiment according to the present invention supporting a method of removing a file-supporting member from a cross-support and attaching it to the same or another cross-support.

FIG. 8 shows a method of creating a system where pockets can be added or removed within a series. For example if the each letter of the alphabet had its own pocket in series and a pocket for "Mc" was desired, between "M" and "N" the file-supporting members could be detached, and a new cross-support and file supporting members could be added in between. In a similar way pockets can be removed from a system. A pocket can be moved from one position to another within the system or moved to another system.

Figure 8B:
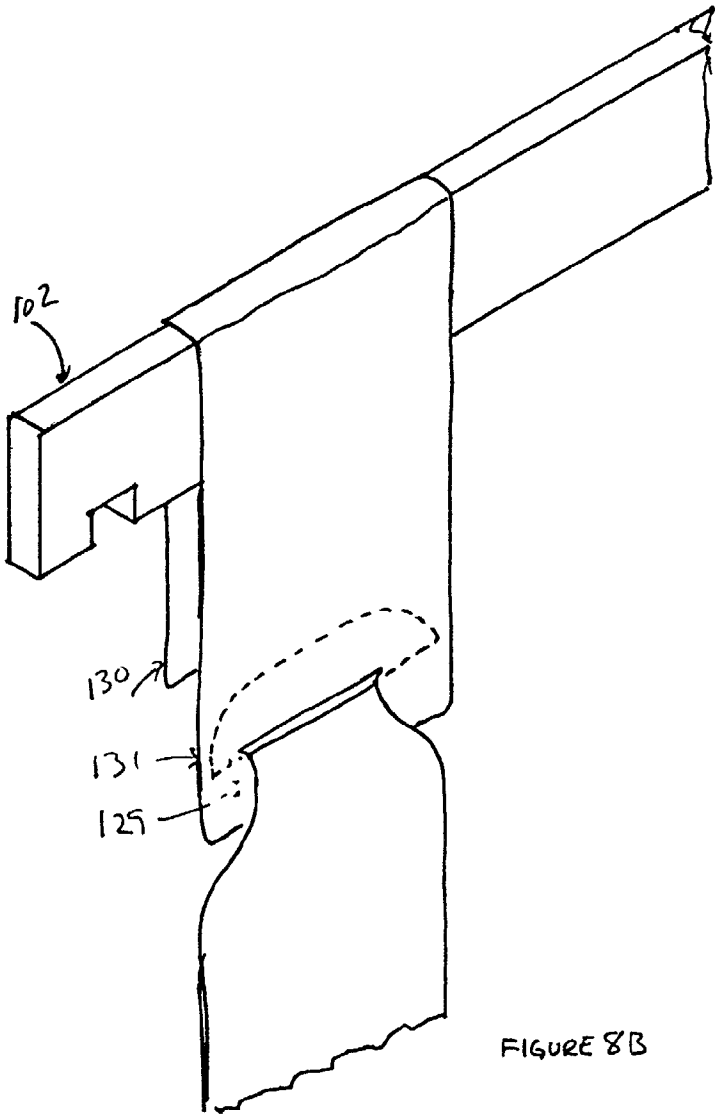
FIG. 8B shows the tab of the FIG. 8 embodiment after it has been removed from the body and inserted through the illustrated slot.
Figure 8A:
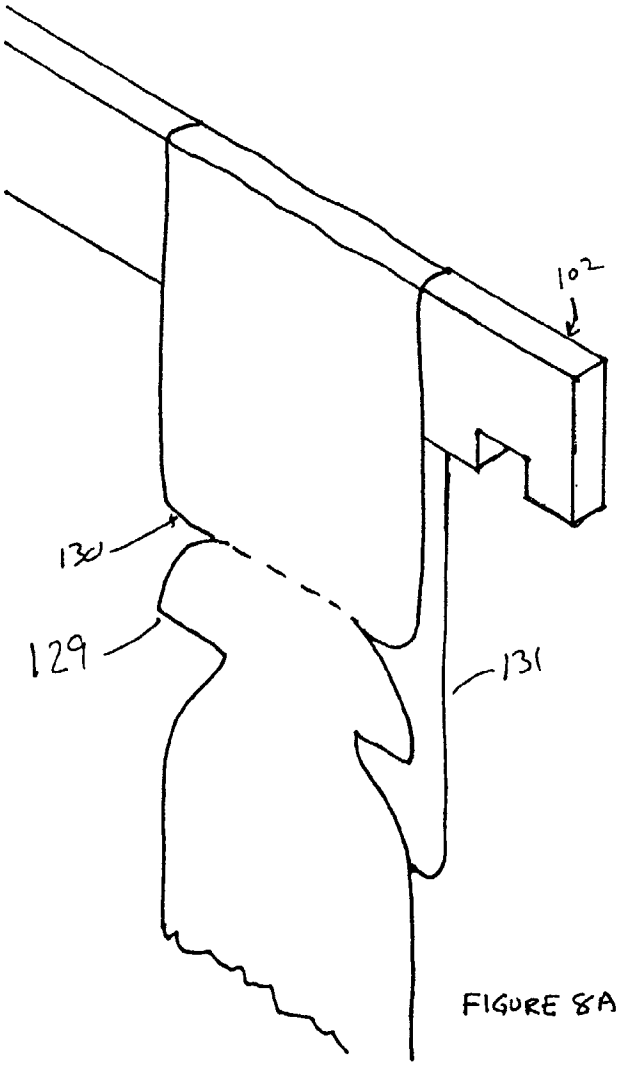
FIG. 8A illustrates the tab of FIG. 8 embodiment in its original, initially continuous and attached orientation.
Figure 8C:
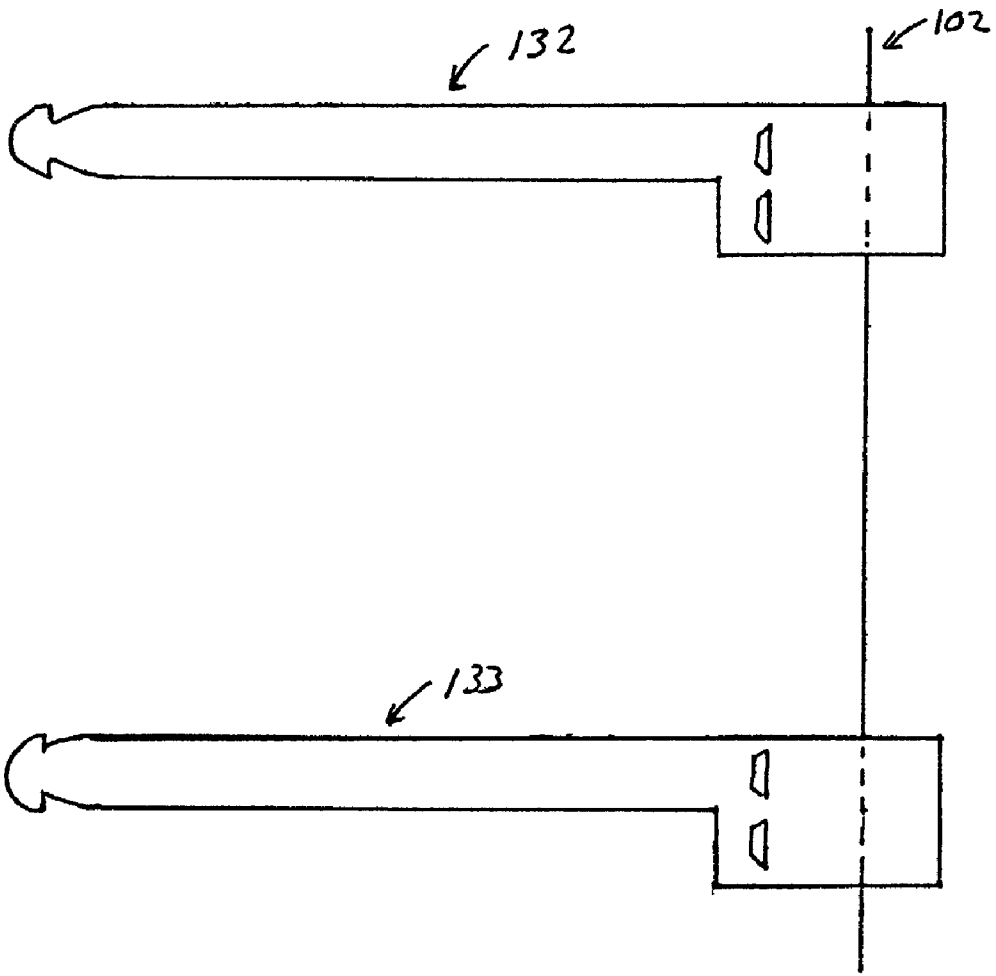
FIG. 8C illustrates a separate piece comprising a cross section and two tab assemblies for adding additional pockets to the embodiment of FIG. 8.

FIG. 8 shows and embodiment with a file-supporting member 128 which is initially continuous and attached to cross-supports 102. Tab 129 is connected to body 130 in a manner that is strong enough to support files but able to be removed. Tab 129 can then be inserted through slot 131 or another similar slot in an adjacent file-supporting member to add a pocket to an existing system. Tab 129 can be fed through slot 131 from the inside of the pocket area in a manner so that Tab 129 does not protrude into the pocket area or cause interference when inserting a file folder into the pocket. FIG. 8A shows tab the original, initially continuous and attached tab 129 and 130. FIG. 8B shows tab 129 removed from 130 and inserted through slot 131 as described above. This embodiment is representative of a variety of methods possible to effect the same result. In this embodiment additional pockets can be added to an existing system in any location by the use of a separate piece comprised of a cross section 102 and two tab assemblies 132 as shown in FIG. 8C.

Figure 8D:
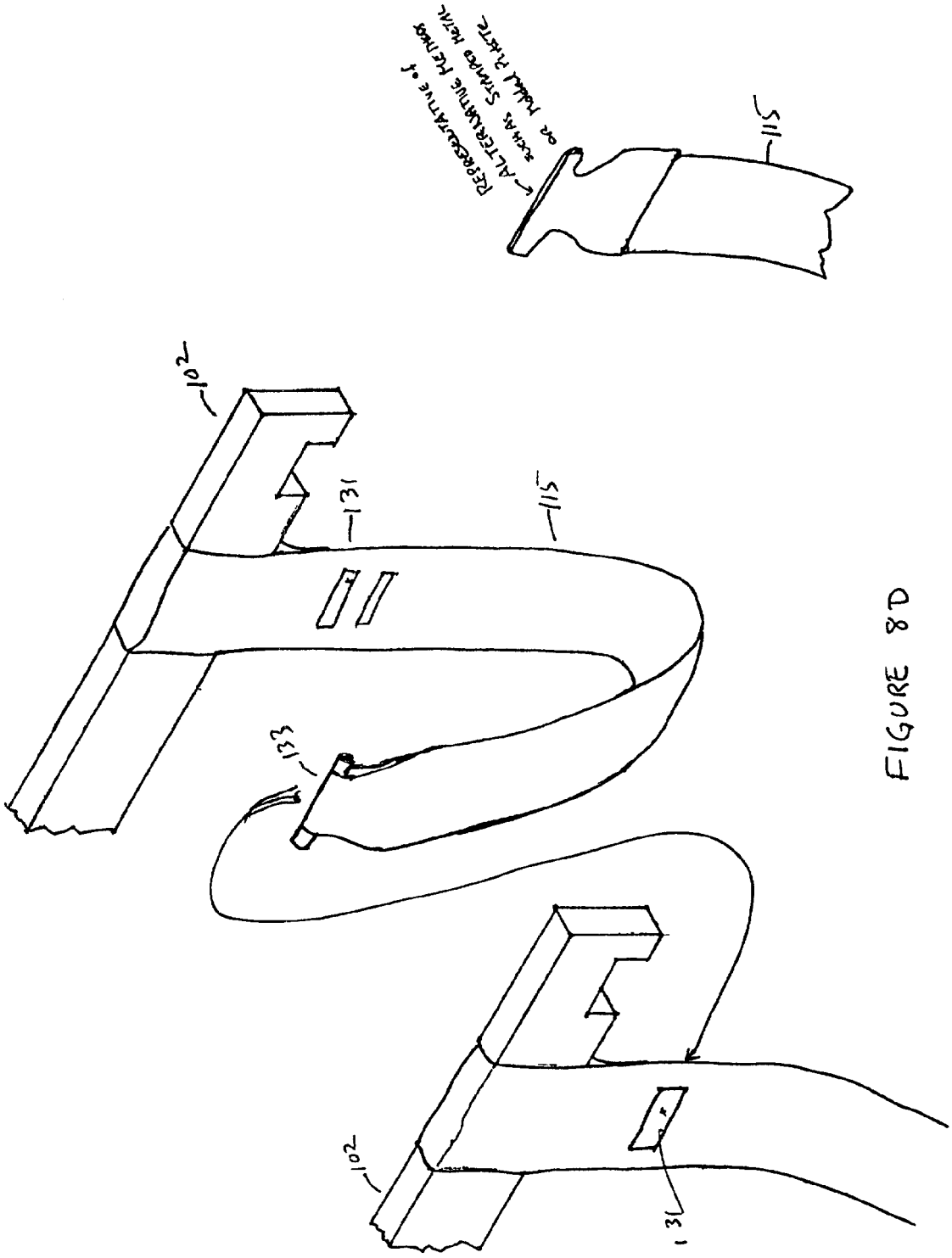
FIG. 8D shows an embodiment of a tab for use with a ribbon-like file supporting member with a rigid member affixed to the end.

FIG. 8D shows an embodiment of a tab for use with a ribbon-like file-supporting member 115 with a rigid member 133 affixed to the end. 133 can then be inserted through a slot 131 to create a new file-supporting member for a new pocket. FIG. 9E shows an embodiment of an alternative method of affixing the separate portions of the file supporting members to form a pocket. Other alternative methods are included within the scope of this patent even though not shown.

Figure 9:
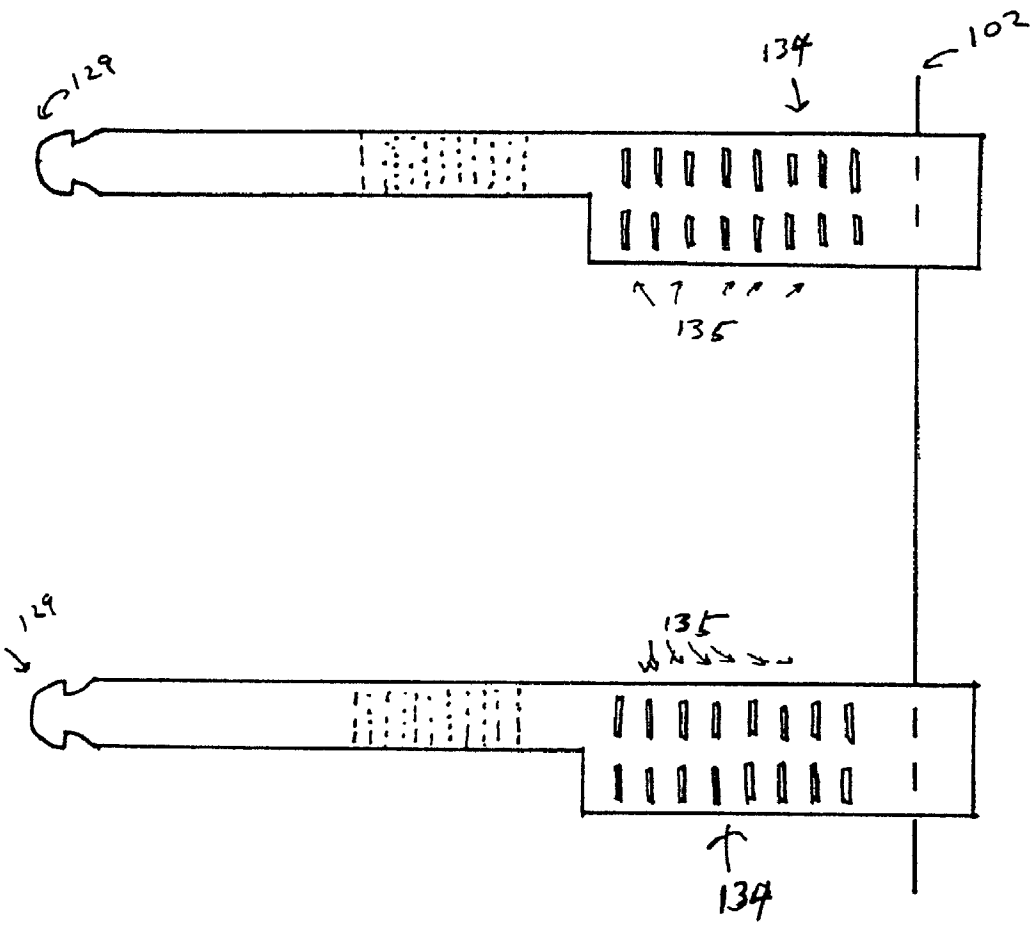
FIG. 9 shows one embodiment according to the present invention with a method of creating a pocket with a variable depth.
Figure 9A:
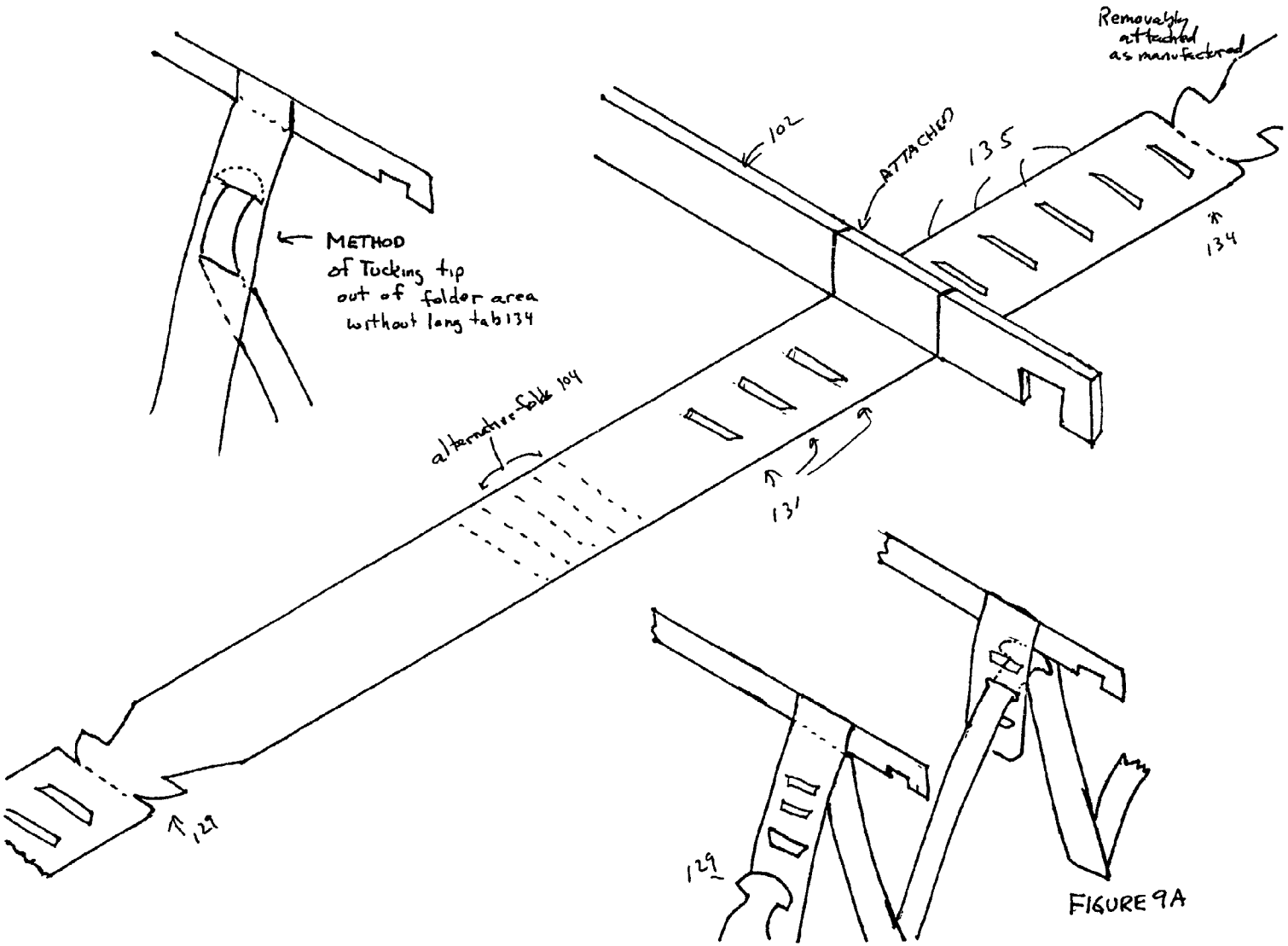
FIG. 9A shows a second embodiment similar to FIG. 9 for creating a pocket with variable depth.

FIG. 9 shows an embodiment in which any method similar to FIG. 8 can be used to create adjustable depth pockets. By creating additional slots 131 at various distances from cross-support 102, the depth of the pockets can be increased as desired. An element of the tab 130 is extension 134 which includes a single or multiple slots 135. By using tab extension 134 and slots 135 the tip 129 can be used to create a connection with the tip of the tab tucked back out of the filing area of the pocket. As shown in FIG. 9A.

Figure 9B:
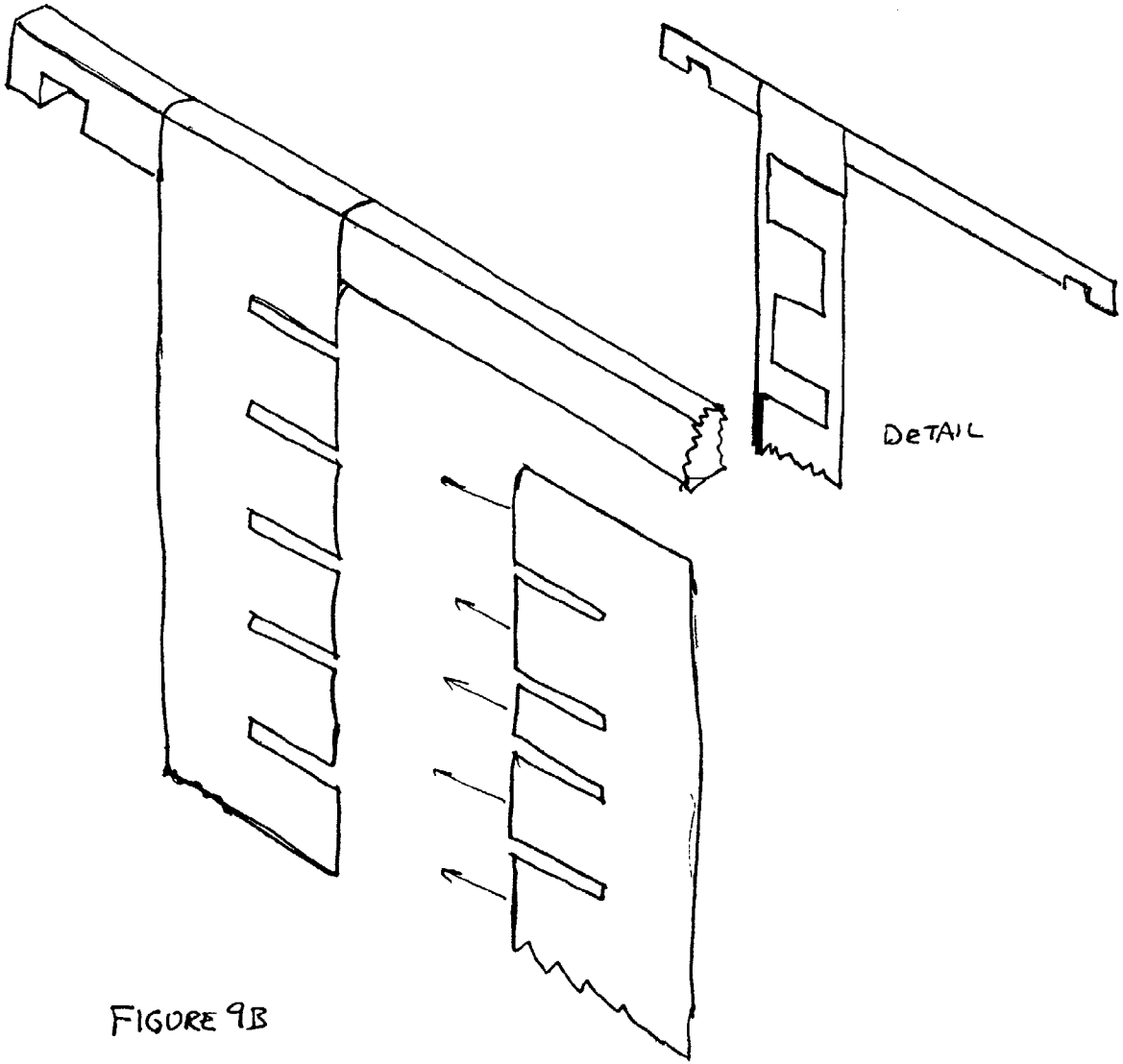
FIG. 9B shows a third embodiment similar to FIG. 9 for creating a pocket with a variable depth.

FIG. 9B shows an alternative embodiment demonstrating that there are multiple methods of effecting the same result.

Figure 10:
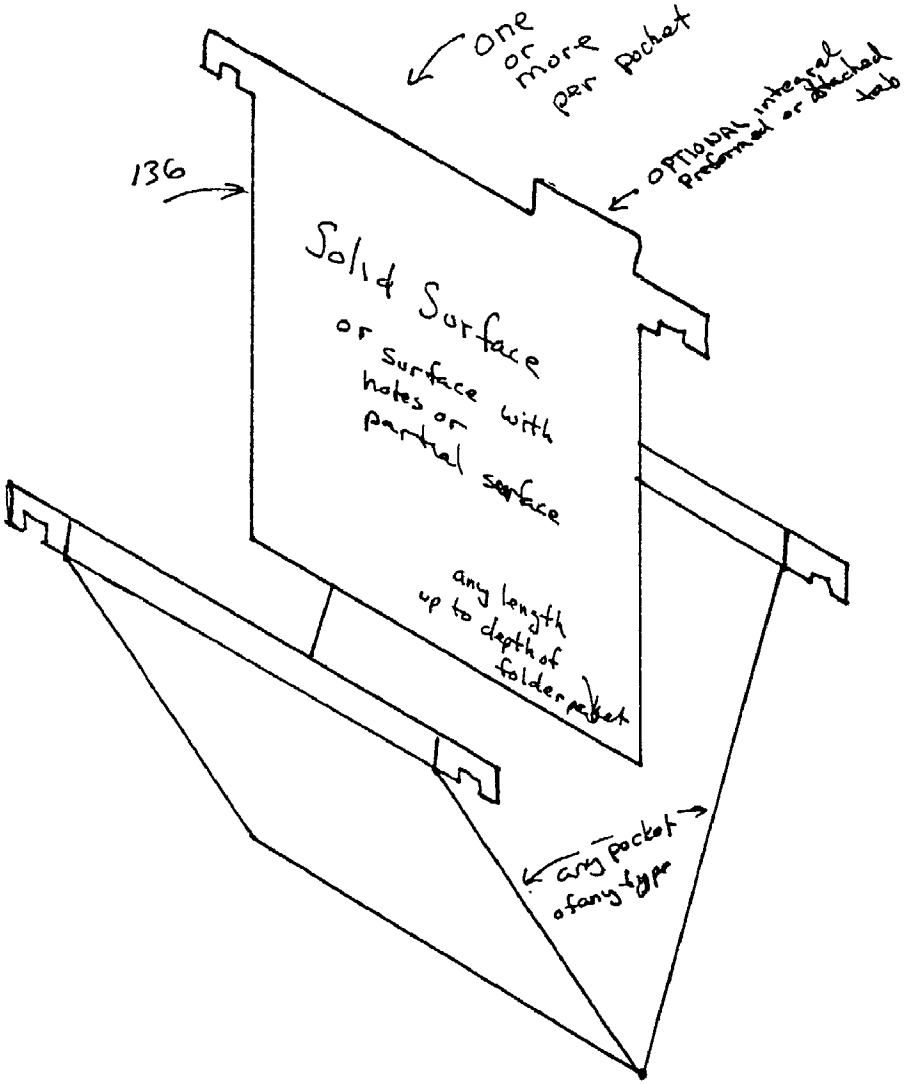
FIG. 10 shows one embodiment according to the present invention of a divider which hangs on the lengthwise supports to create multiple, individually identifiable areas in a single pocket.

FIG. 10 shows one embodiment according to the present invention of a divider 136 which hangs on the lengthwise supports 105 to create multiple, individually identifiable areas in a single pocket. One or more of these dividers can be used per pocket.

Figure 11:
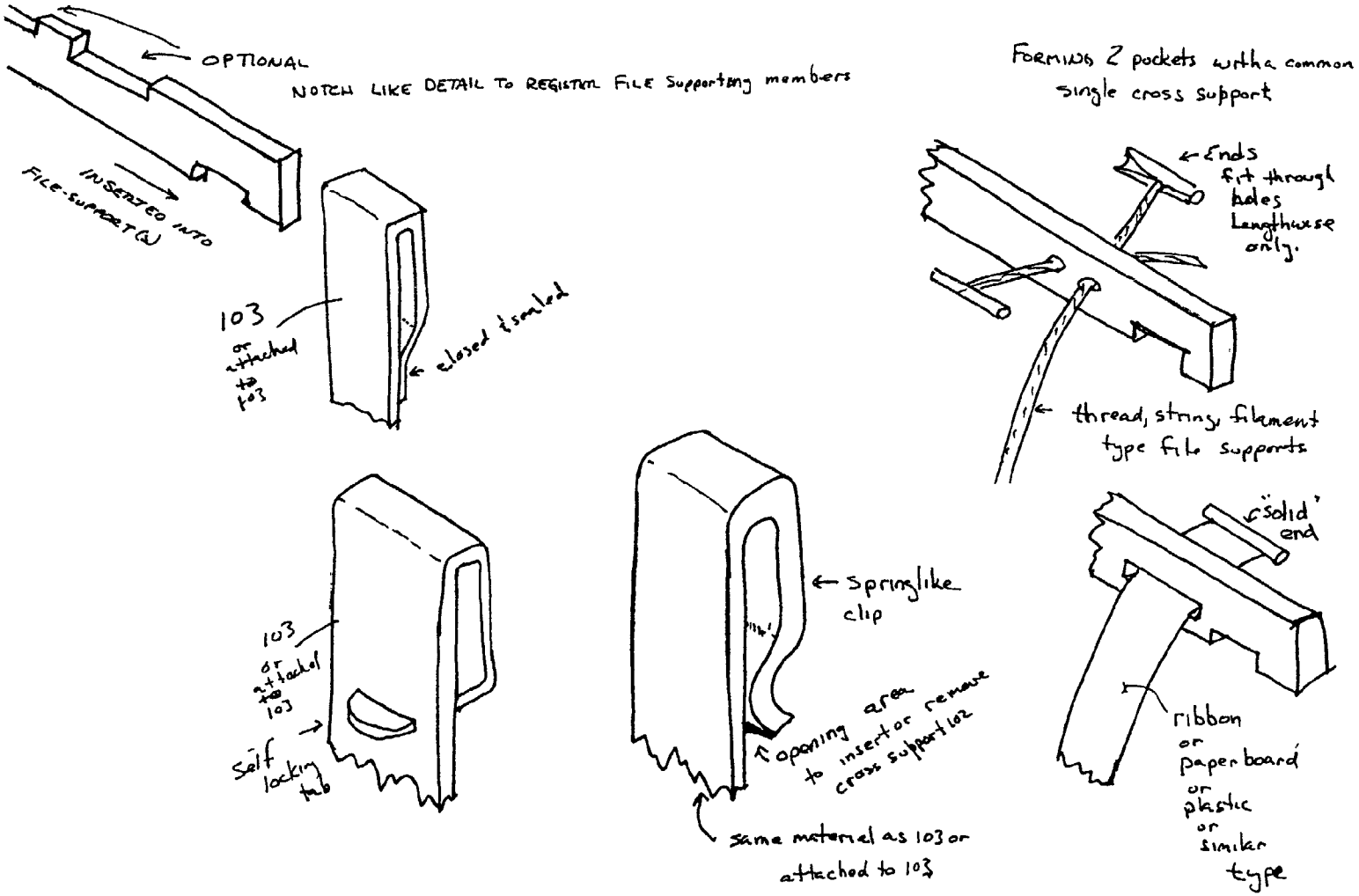
FIG. 11 shows one embodiment according to the present invention with a method of attaching the file-supporting member to the cross-support with notches, holes or slots.

FIG. 11 shows representative examples of how an individual file-supporting member can be removably attached to a cross-support member. An advantage of this is creating a system which an end user can modify by adding or removing pockets, changing the position of the pocket within the system or moving it to another system.

Figure 11A:
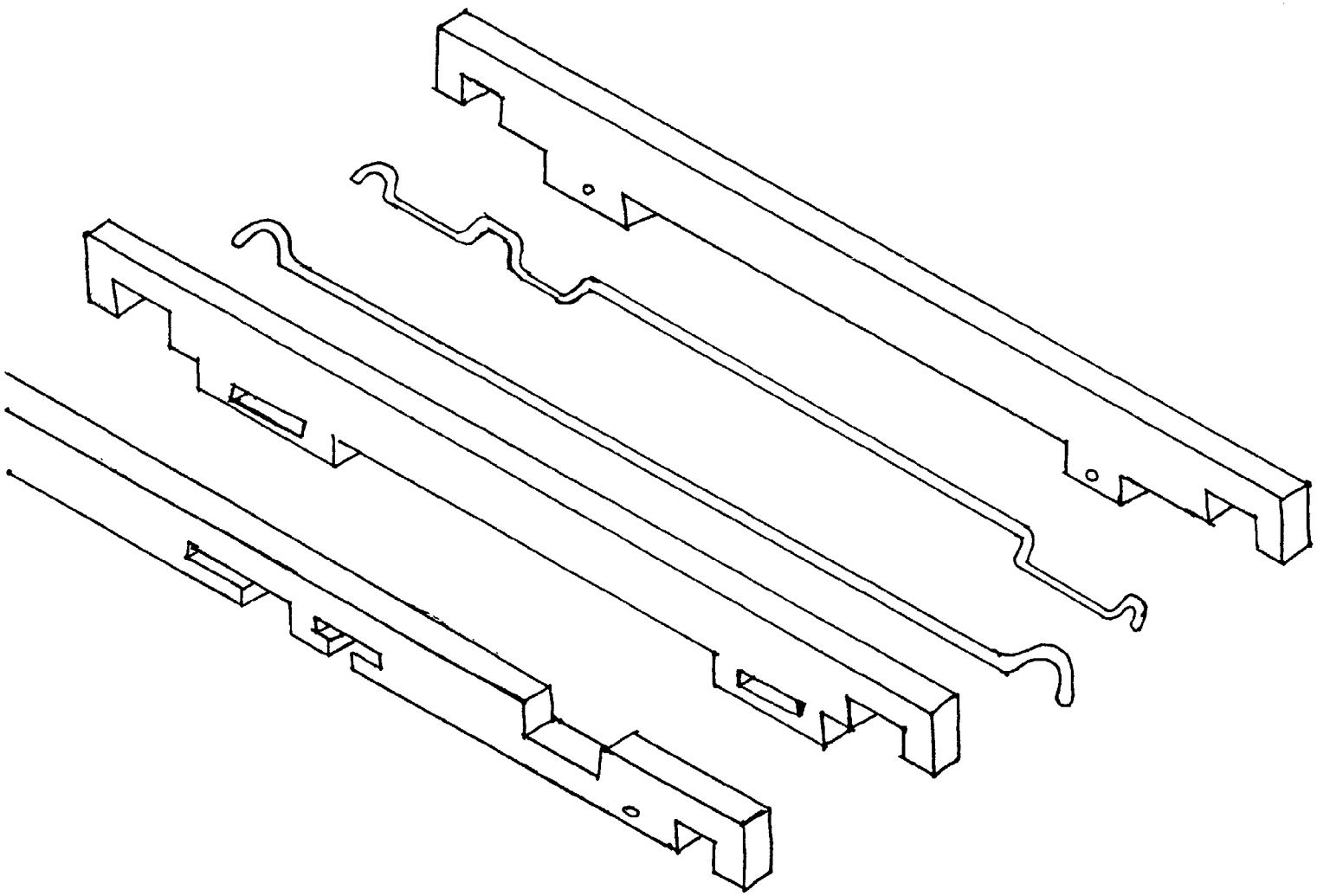
FIG. 11A shows representative embodiments for attaching file-supporting members to the cross-supports.

FIG. 11A shows representative examples of attaching file-supporting members to the cross supports at or below the point of contact of the cross support to the lengthwise supporting member. This is done for stability. What is shown is a file support method using only two file supporting members per pocket but any number is possible. It is also possible to be supported below the contact point of the cross support to the lengthwise support without adding a feature protruding downward from the general bottom of the cross section member. A cut may be made from the top or from the center or from the bottom. The cross member may be a formed piece such as a round metal bar with bends to allow it to hand on the lengthwise supports without easily coming off either end and with bends to allow the file supporting member or members to be supported at a point below that of contact between the cross support and the lengthwise support.

Figure 12:
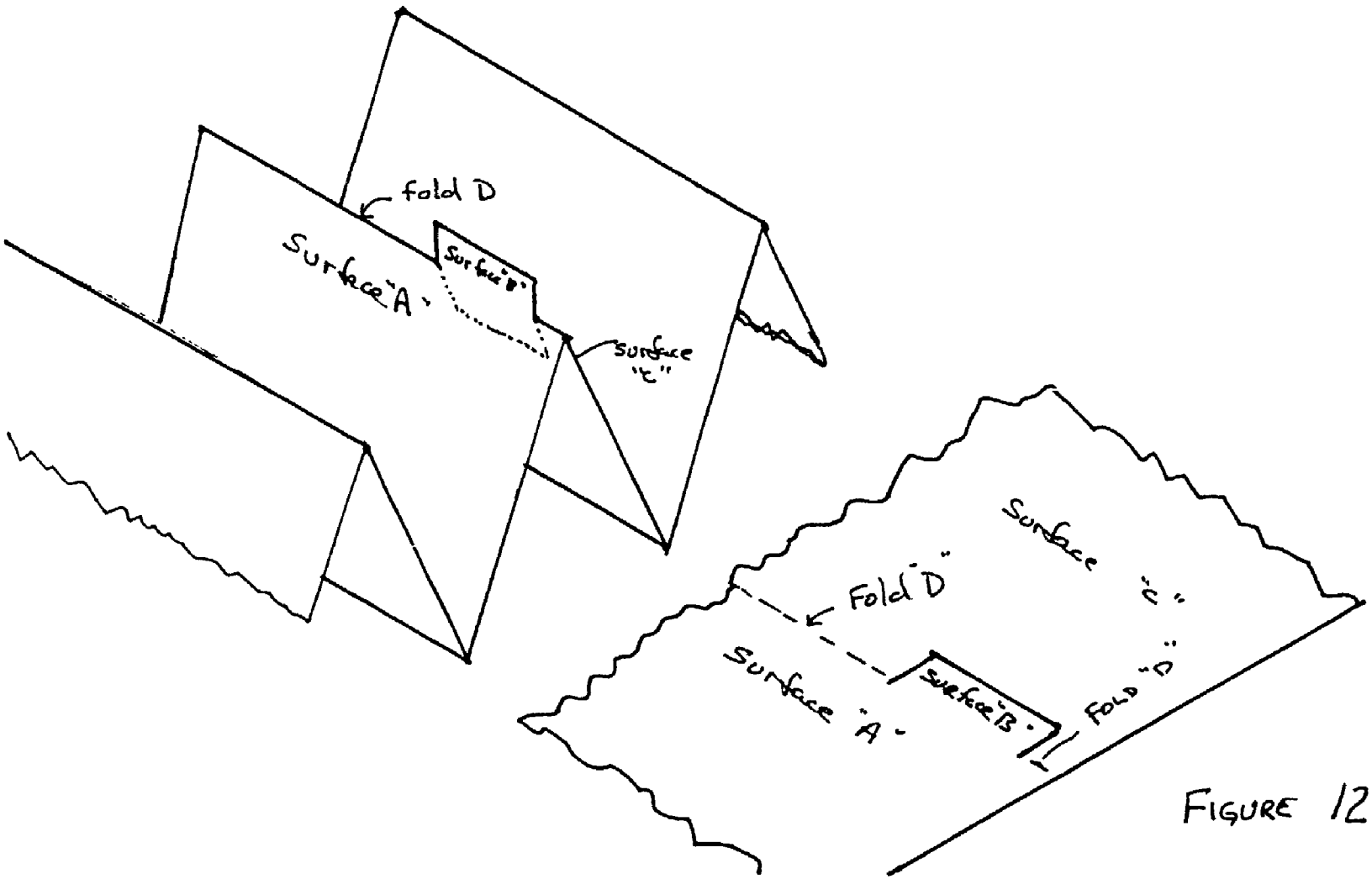
FIG. 12 shows one embodiment acording to the present invention with a method of creating a tab of the same material as the file-supporting member and rises somewhat vertically above the cross-support.

FIG. 12 shows one embodiment according to the present invention with a method of creating a tab of the same material as the file-supporting member and rises somewhat vertically above the cross-support. This applies to any use of the body material to create or assist in the creation of any tab or structure above the traditional fold line. This applies to single pockets with two cross members as currently used as well as any other embodiment covered in this patent application or envisioned by patent application.

Figure 13:
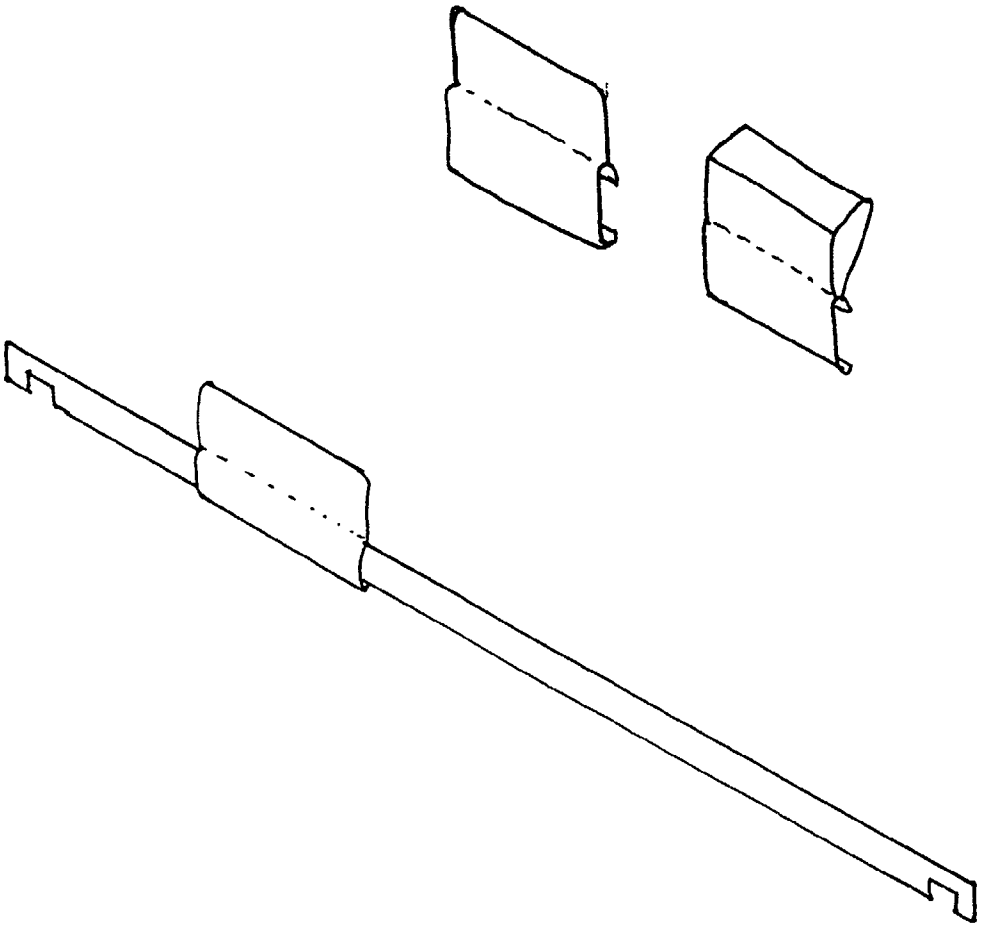
FIG. 13 shows one embodiment according to the present invention with a method of creating a tab which is attachable to the cross-support and rises somewhat vertically above the cross-support.

FIG. 13 shows an embodiment according to the present invention with a method of crating a tab which is attachable to the cross-support member itself and rises somewhat vertically above the cross-support. This tab may be adjustable, movable or removable. This tab may or may not touch any part of the file-supporting member. It may present a flat, multiple flat, curved or multiple curved surfaces which may be used to indicate the contents of an adjacent pocket by a variety of means.

Figure 14:
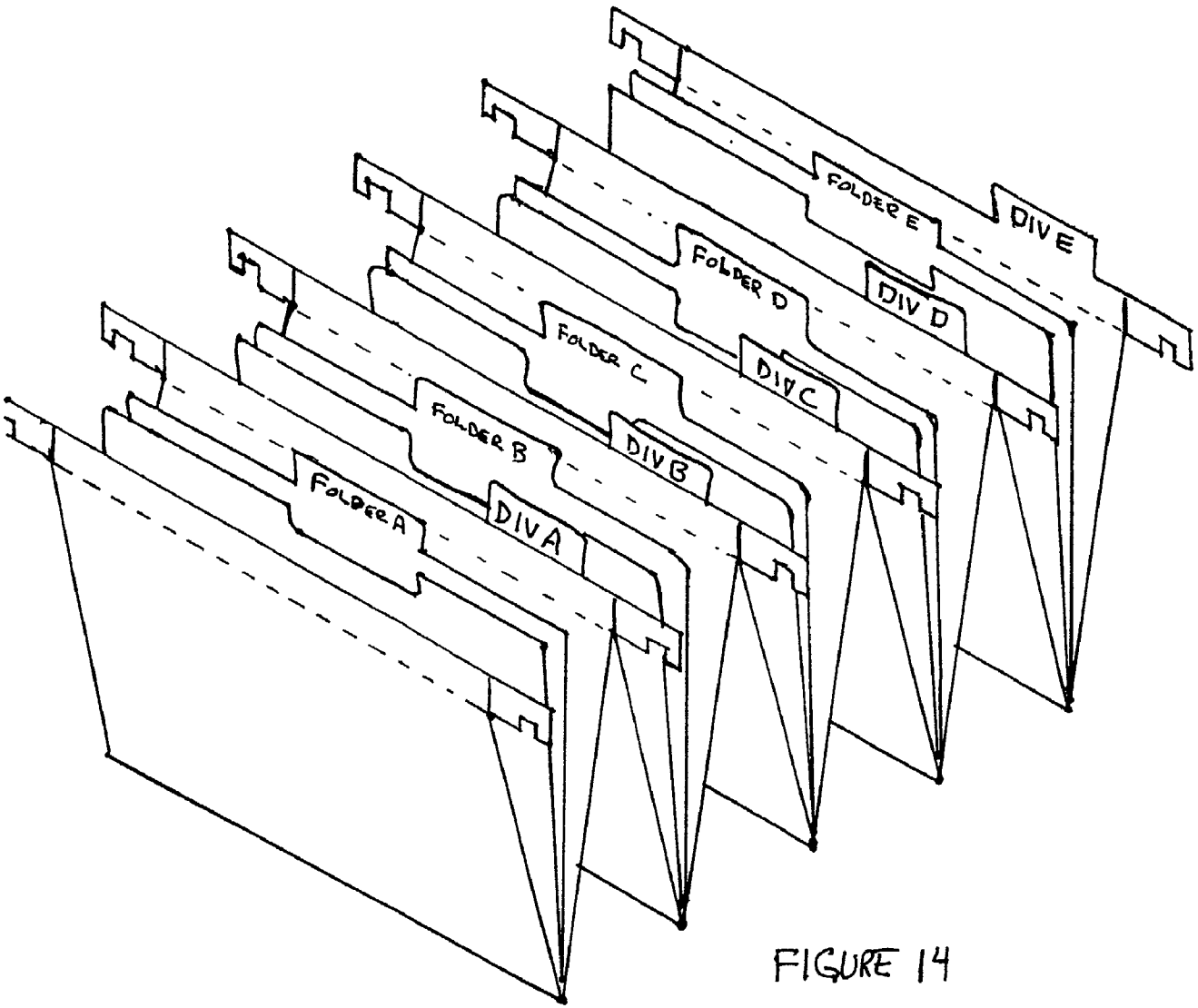
FIG. 14 shows one embodiment according to the present invention wherein one or more manila-type file folders are pre-labeled to correspond to their respective pockets in the hanging file folder pocket system with a method that correlates to the marking on the pocket tab.

FIG. 14 shows one embodiment according to the present invention wherein one or more manila-type file folders are pre-labeled to correspond to their respective pockets in the hanging file folder pocket system with a method that correlates to the marking on the pocket tab.

Figure 15:
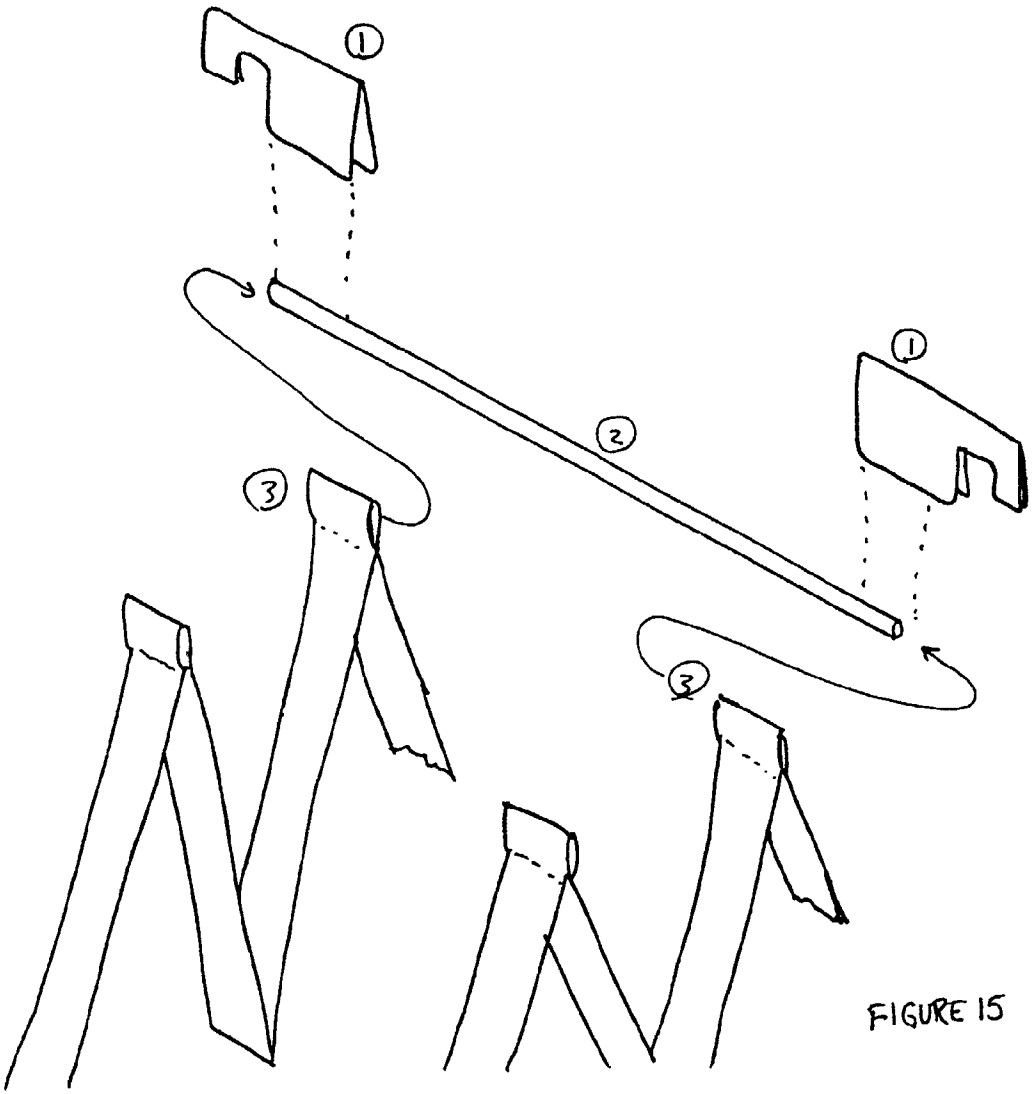
FIG. 15 shows one embodiment according to the present invention with a method of creating a pocket with non solid sides such a holes or made of web or net or ribbon or string suspended between two lengthwise supports on a supporting member that is not a single bar.

FIG. 15 shows an embodiment with the key features of I) a method of touching on and supporting on and generally registering to the lengthwise support members 2) a method of effectively maintaining a rigid member between the members mentioned in 1) and 3) a method of supporting files papers or other items or objects with less than solid walls or more than one or more file supporting members effectively attached to a front cross member and to a rear cross member.

CONCLUSION

The present invention provides a hanging file system and the components thereof for maintaining papers, files, and other objects and items in discrete pockets or divisions, it also provides a means to prevent items from being misplaced between pockets or divisions, it also provides a means of using less of the space for the system itself than is currently possible, it also provides a means to accomplish the current method of filing and this new method of filing using less materials, it also provides a means of packaging for shipment or sales in a box much smaller than currently possible.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A hanging file system, comprising:

first and second cross-support members disposed in a spaced arrangement along a length of a file enclosure; and a file supporting pocket, adjustable in size, disposed between and supported by said first and second cross-support members for accommodating file folders and the like;

wherein said file supporting pocket comprises a plurality of adjacent, spaced segments of material, with openings between said adjacent segments, and said size adjustment is accomplished by attaching said file supporting pocket to one or both of said cross-support members at different locations on said file supporting pocket.

2. The hanging file system as recited in claim 1, wherein an end of said file supporting pocket is removable from one cross-support member and re-attachable to a different cross-support member.

3. The hanging file system as recited in claim 1, and further comprising one or more additional file supporting pockets.

4. The hanging file system as recited in claim 3, wherein each of said file supporting pockets are detachable from corresponding cross-support members so that file supporting pockets may be added or removed from said system.

5. The hanging file system as recited in claim 1, and further comprising an identifying tab which is directly attached to one of said cross-support members for displaying identifying information concerning file contents.

* * * * *